US005398383A

United States Patent [19]

Bingold

[11] Patent Number: 5,398,383

[45] **Date of Patent: * Mar. 21, 1995**

[54] TWO-LOOP, DISPOSABLE, PLASTIC LAW ENFORCEMENT RESTRAINT

[76] Inventor: Richard F. X. Bingold, 8223 S. Main St., Cicero, N.Y. 13039

[ * ] Notice: The portion of the term of this patent subsequent to Nov. 3, 2009 has been disclaimed.

[21] Appl. No.: 970,398

[22] Filed: Nov. 2, 1992

Related U.S. Application Data

[63] Continuation-in-part of Ser. No. 638,618, Jan. 8, 1991, Pat. No. 5,159,728.

[51] Int. Cl.[6] ..... E05B 75/00; B65D 63/00

[52] U.S. Cl. ..... 24/16 PB; 70/16

[58] Field of Search ..... 70/15–18; 24/16 R, 16 PB, 17 AP, 30.5 P, 484; 248/74.3

[56] References Cited

U.S. PATENT DOCUMENTS

| | | | |
|---|---|---|---|
| 4,532,679 | 8/1985 | Scott | 24/16 PB |
| 4,688,302 | 8/1987 | Caveney et al . | 24/16 PB |
| 4,910,831 | 3/1990 | Bingold | 24/16 PB |
| 5,088,158 | 2/1992 | Burkholder | 24/16 PB |
| 5,159,728 | 11/1992 | Bingold | 70/16 X |

*Primary Examiner*—James R. Brittain

*Attorney, Agent, or Firm*—Charles S. McGuire

[57] ABSTRACT

A disposable, loop-type restraint includes a central portion having a pair of sockets with through openings, separated by a bridging portion, and flexible straps extending in opposite directions from the central portion. Each strap may be formed in a loop with end portions inserted through a respective socket opening. A series of ratchet teeth is formed along one surface of each strap and pawl within each socket opening has a pair of adjacent teeth for engaging ratchet teeth on the straps to permit movement of the straps through the socket openings in an insertion direction and prevent movement in a withdrawal direction. Other features include tag portions between the central portion and each strap having a patina finish for receiving inked identifying indicia, tip portions on the straps having saw teeth along each of their opposite surfaces and a pair of apertures through the bridging portion to receive the tip portions of the straps and provide a compact storage position for the device.

17 Claims, 11 Drawing Sheets

TWO-LOOP, DISPOSABLE, PLASTIC LAW ENFORCEMENT RESTRAINT

REFERENCE TO RELATED APPLICATION

This application is a continuation-in-part of U.S. patent application Ser. No. 638,618, filed on Jan. 8, 1991, now U.S. Pat. No. 5,159,728.

FIELD OF THE INVENTION

This invention relates to law enforcement restraining devices and more particularly relates to a two-loop strap restraint which is concealable, disposable and can be formed entirely of recylcable material. The strap restraint is removed from the person or animal being restrained by cutting or snipping it off, thus not requiring a key for opening.

A prior two-loop law enforcement restraining device is disclosed and claimed in my U.S. Pat. No. 4,910,831, issued Mar. 27, 1990.

The conventional restaining device used by law enforcement officers and others consist of a pair of connected metal rings that can be locked about the wrists of a prisoner to keep him from using his hands or to fasten him to the law enforcement officer or to some other object such as a fence or a post or attachment to an anchoring member in a transport vehicle. Those conventional handcuffs require a key, are bulky, heavy, and the oval opening defined, though adjustable in length, is not adjustable in width for snugly engaging different thicknesses of wrists or ankles.

In addition, when multiple arrests are involed, multiple sets of handcuffs .may be required, which burden the officers with carrying a plurality of rather difficult to handle and heavy metallic objects. Such metal handcuffs will activate metal detectors in airports, courthouses, prisons, government buildings and other protected structures, thus giving rise to awkward, confusing and complicating situations during transport and legal processing of an arrested person.

Law enforcement work requires handling of individuals for transporting and transferring from one facility to another. For processing, booking, etc., the prisoners normally are turned over from one officer or agency to another, thereby requiring one set of handcuffs to be removed and given back to the first officer (who is transferring the prisoner to a second officer) and for the application of a different set of handcuffs provided by the transferee. Any change, or removal and replacement of the restraining devices on a prisoner is dangerous and provides an avenue of opportunity for the prisoner to injure an officer or escape while such transporting transfers are being made.

Further, each removal and replacement of sets of handcuffs necessarily inherently involves close physical contact between the law enforcement personnel and the prisoner. Such close contact unfortunately exposes the law enforcement personnel to the hazard of contracting diseases, particularly so if the prisoner is bleeding or is coughing from respiratory disease.

Moreover, since a key is necessary to remove conventional handcuffs, the transporting or arresting officer may be assaulted in attempts to obtain the key. In other words, the use of the conventional, expensive, key-opened handcuffs as restraining devices provide a plurality of problems and risks when they are applied or removed from the person or persons to be restrained and during transport of a restrained person or persons.

SUMMARY OF THE DISCLOSURE

Accordingly, it is an object of the present invention to provide a new and improved law enforcement strap restraint which is lightweight, strong, inexpensive, disposable, can be formed entirely of recyclable polymeric material and is easy to use, easy to operate and store and is less complex than prior art types of restraints.

By virtue of the fact that this strap restraint is inexpensive and disposable and does not involve the use of a key, the same restraint may remain securely positioned on a prisoner until the subject reaches an intended detention facility before the restraint is removed by cutting or snipping it off.

Moreover, since a strap restraint embodying the invention is formed entirely of polymeric material, it will not activate metal detectors. Thus, this novel strap restraint facilitates movement of a restrained prisoner into and out of locations protected by metal detectors, such as airports, prisons, courthouses, government buildings and so forth.

The strap restraints are made of a tough, strong, stiffly flexible polymeric material, are lightweight, and a considerable number of them may be carried conveniently concealed by a law enforcement user and are disposable, as contrasted with the bulky, expensive, heavy, metal handcuffs, which require an accompanying key for release.

A further object of this invention is to provide a novel and improved, two-loop law enforcement restraining device which is not complex and facilitates restraining individuals alone or in a group, helping in the handling of individuals for the transportation transfer from one facility to another and during the processing of the individuals with no risk involved which would be involved in removing and replacing conventional handcuffs during transfer from one officer to the next as often occurs in such operations.

Still another object of this invention is to provide a new and improved two-loop law enforcement restraining device which facilitates the restraint and movement of multiple subjects.

Still a further object of this invention is to provide a new and improved two-loop law enforcement restraining device which is simple to operate, is light weight, inexpensive and disposable and may be safely applied and is not key-operated.

Another object of the present invention is to provide a new and improved two-loop law enforcement restraining device which reduces the risk in handling prisoners that might otherwise subject the law enforcement officers to repeated contact or close association with prisoners who might be bleeding and might have a blood-contact conveyable disease, or might have some infectious respiratory disease.

Among the advantages of a strap restraint embodying the present invention are those arising from the fact that this restraint has a pair of apertures in its central bridging portion for enabling the strap restraint to be curled into a compact four-loop configuration for convenience in carrying several of them by a law enforcement officer in an unobtrusive, concealed manner, for example, in a pocket.

This strap restraint fits all sizes of wrists and ankles for use in a wide variety of law enforcement situations, including securing together two or more subjects in custody as in quelling riots or gangs or in military situations involving prisoners, or in medical situations involving necessary restraint of a viciously violent Or self-destructively-acting individual, or even in hobbling a prisoner who has kicked at another person.

In carrying out this invention in an illustrative embodiment thereof a law enforcement restraining device of the double-loop type for attachment around the wrists or ankles of the restrained person comprises a disposable, single, elongated strap restraint having first and second stiffly flexible, longitudinally extending ratchet portions. The strap includes first and second latching socket bosses spaced longitudinally of the strap and being located near the center of the strap between the first and second stiffly flexible ratchet portions. The first and second rachet portions have respective first and second tip portions, and the strap includes a central bridging portion extending between the first and second latching socket bosses. The bridging portion has a width at least substantially commensurate with the width of the latching socket bosses; and this bridging portion has first and second apertures therein spaced longitudinally of the strap. These apertures have sufficient size for enabling the strap to be curled into a compact four-loop configuration with a ratchet portion and also a tip portion extending through each of said apertures in withdrawable relationship.

In a first embodiment of the invention, the tip pull portions taper inwardly to a smoothly rounded terminal end and include saw teeth longitudinally extending along only the outwardly facing surfaces thereof for insertion into respective socket openings within each latching socket boss. The bridging portion further includes a pair of ribs integrally traversing opposite edges thereof to provide additional strength between the latching socket bosses. For future reference, the "outwardly" facing surfaces of the securing straps are those that face in a direction away from the wrist or ankle when the restraint is attached thereover, and the "inwardly" facing surfaces of the securing straps are those that contact the skin and face toward the wrists or ankles.

In a second embodiment of the invention, the latching socket bosses each include double latching socket pawls for improved retention of the ratchet portion of the strap therein. The tip pull ends of the elongated ratchet portions are formed with an enlargement which engages the edge of an associated aperture in the bridge when folded into the four-loop storage configuration mentioned above. The tip pull ends are further provided with saw teeth on both surfaces thereof to increase grip and handling thereof.

Following passage of each ratchet portion through their respective latching socket boss when restraining the wrists or ankles, the ratchet portions may be snipped off at the point where they exit the latching socket boss. The terminal, enlarged ends of the cut ratchet portions may thereafter be inverted and inserted between the latching socket pawls and the wall of latching socket boss opposite the secured ratchet portion thereby even further tightening the securement of the ratchet portion of the strap Within the latching socket boss. This method of auxiliary strap securement has proven very successful at eliminating occurrences of release of a secured strap by tampering with the latching socket boss.

BRIEF DESCRIPTION OF THE DRAWINGS

FIG. 5 is an enlargement of the tip pull and ratchet portions of the strap restraint shown in FIG. 3;

FIG. 6 is a view looking upwardly at the restraint portion shown in FIG. 5. It is an enlargement of portions of the strap restraint shown in FIG. 4;

FIG. 7 is an enlargement of the section shown in FIG. 3;

DETAILED DESCRIPTION

Figure 1:
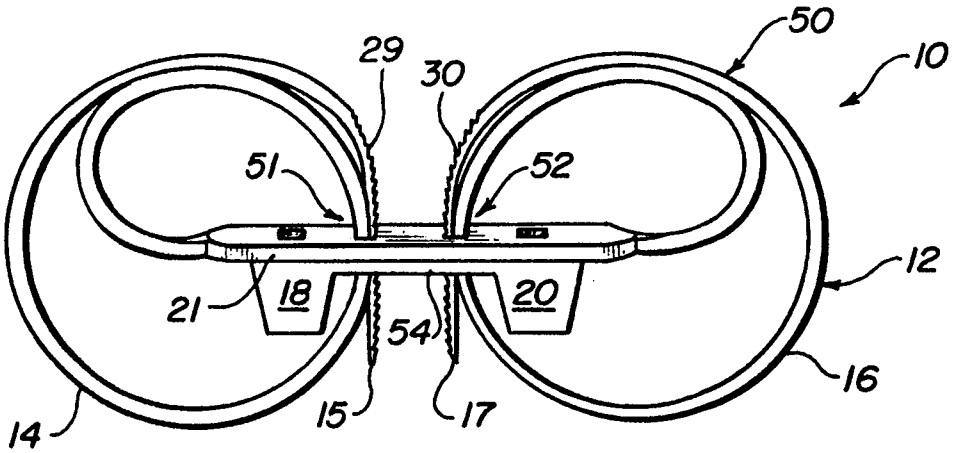
FIG. 1 is a perspective view of a first embodiment of the enforcement strap restraint shown curled into a compact four-loop configuration for ease of carrying in an unobtrusive, concealed manner.

A law enforcement strap restraint embodying the present invention has no need for a key to unlock either loop once it has been applied around the wrist or ankle of a restrained prisoner, for this restraint is in the general form of a stiffly flexible strap of polymeric material; it is disposable and is cut for removal. The strap restraining device is bent for forming two loops adapted to restrain either humans or animals and is attached to limbs, such as arms and legs, in the vicinity of the wrists and ankles, respectively.

Among the advantages of the lightweight strap restraint are those resulting from the fact that a law enforcement officer can easily carry a plurality of them. These stiffly flexible strap restraints can readily be looped around each other in numerous ways for being coupled together with one or more of the loops being attached to the same or other individuals or animals, and such coupling may include anchoring one of the loops to a stationary member such as a post, pipe, fence or other object or to an anchoring member in a transport vehicle. The restraining device referred to herein will not require a key or other unlatching element and is inexpensive and disposable in that once it has been applied, it is removed by simply cutting or snipping it from the person being restrained.

Since the strap restraint is inexpensive and disposable and does not require an accompanying key for release, the same restraint may remain securely positioned on a subject until reaching an intended detention facility before the restraint is removed by cutting or snipping it off.

Referring to FIGS. 1 through 4, a first embodiment of the law enforcement strap restraint is referred to generally by the reference numeral 10 and comprises a single, elongated, integral, stiffly flexible strap 12 having first and second ratchet portions 14 and 16, respectively, with respective rounded tips 15 and 17. The strap 12 is preferably molded of a lightweight, strong, tough, stiffly flexible, high-strength, engineering-type, thermoplastic, polymeric material, for example, it is molded of engineering grade Nylon 66 or Nylon 6, each being a virgin resin impact-modified to 10 enhance flexibility and having a tensile strength of at least about 7,200 psi (ASTM Test Method D 638).

This tough strap can be cut with a pair of large cutting snips or large cutting shears, but such cutting is not easily done. The strap 12 contains first and second socket bosses 18 and 20, respectively, which are centrally located in the strap 12 generally midway between the first and second rounded tips 15 and 17. It is to be noted that the restraint 10 is symmetrical about a transverse centerline 19 (FIGS. 2, 3 and 4) and thus the socket bosses 18 and 20 are each located the same relatively small distance "D" on either side of this centerline 19. There is a relatively wide bridging portion 21 of the strap 12 which spans between and is integral with the respective socket bosses and is reinforced by two longitudinal ribs 54 for strongly and securely interconnecting these sockets. This restraint 10 is also advantageously symmetrical about a longitudinal centerline axis 23 (FIGS. 2 and 3), so that it is conveniently reversible end-for-end when being applied. In other words, the user need not waste time in checking which tip 15 and 17 is to be inserted first, because of the advantageous symmetry of this useful tool 10.

Figure 3:
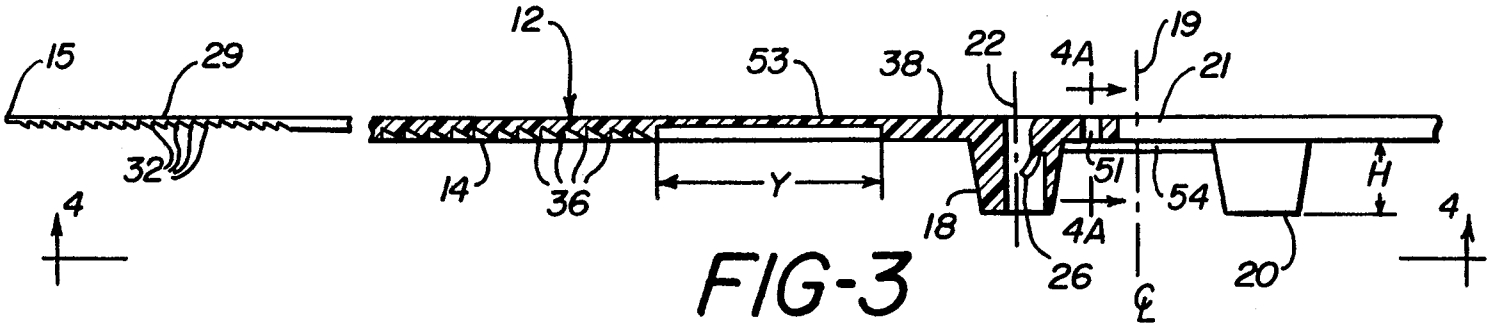
FIG. 3 is a side elevational view in partial, longitudinal cross-section of somewhat more than one-half of the strap restraint shown straightened out as taken generally along the line 3—3 in FIG. 4.
Figure 7:
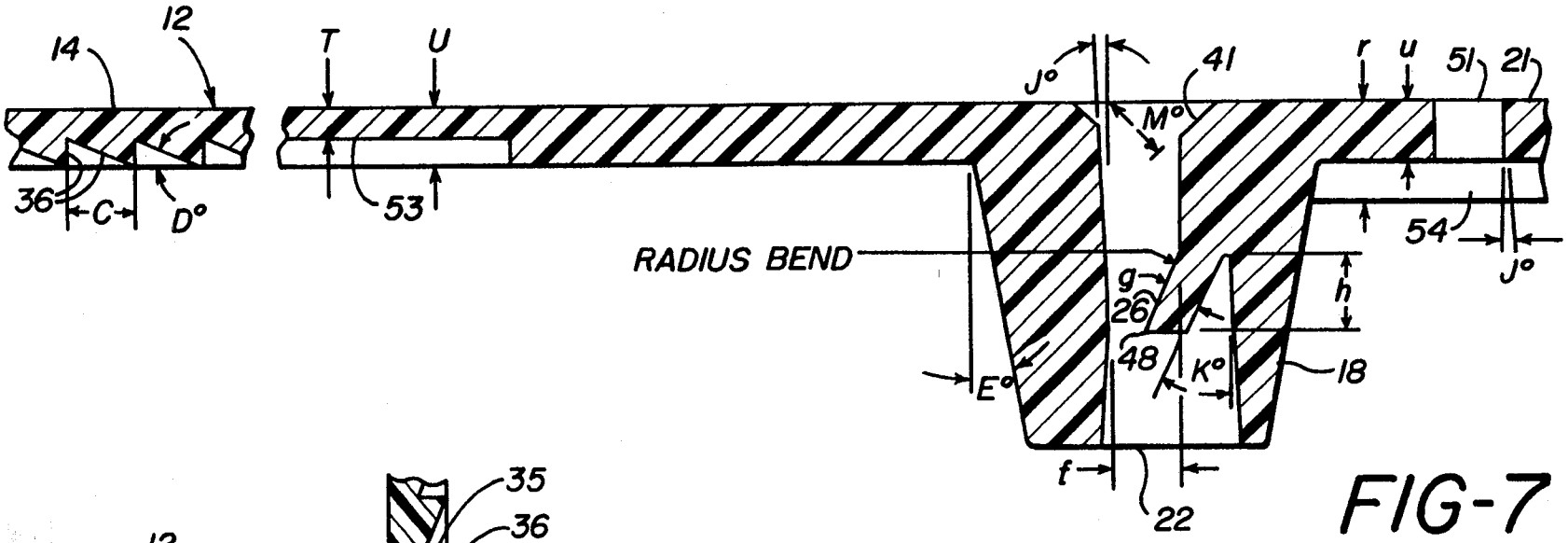
FIG. 7 is a longitudinal, cross-sectional view of a latching socket and an adjacent portion of the strap restraint shown enlarged about four times.
Figure 8:
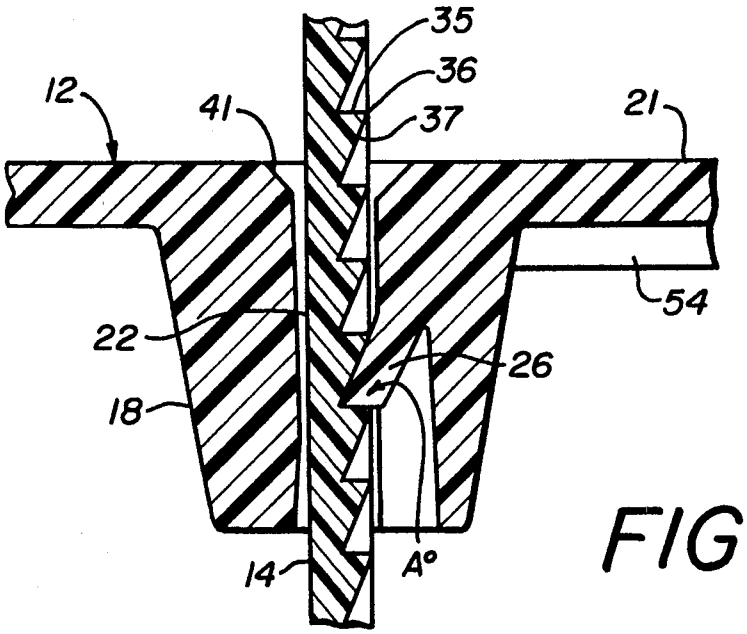
FIG. 8 is a cross-sectional view of the latching socket as shown in FIG. 7 showing a resilient latching pawl engaged with an inserted ratchet portion of the restraining device. The resilient latching pawl is non-metallic, being molded integral with the socket boss.

The first and second spaced socket bosses 18 and 20 have central openings 22 and 24, respectively, extending therethrough which openings are substantially perpendicular to the plane of the elongated straight strap 12 as will best be seen in FIGS. 3, 7, and 8. As seen in FIGS. 3, 7 and 8, the socket 18 includes a downwardly extending resilient latch pawl 26 which is inclined downwardly in a direction away from the transverse centerline 19. This latch pawl 26 projects into the opening 22 of the socket 18 for latching purposes explained hereinafter. The other socket 20 also includes an identical downwardly inclined resilient latch pawl 28 which projects downwardly into the opening 24 in a direction away from the centerline 19. These latch pawls 26 and 28 are molded of the same polymeric material used for molding the strap 12 and socket bosses 18 and 20, so that these pawls are integral with their respective socket bosses. By virtue of being non-metallic, these pawls 26 and 28 will not activate metal detectors.

Figure 2:
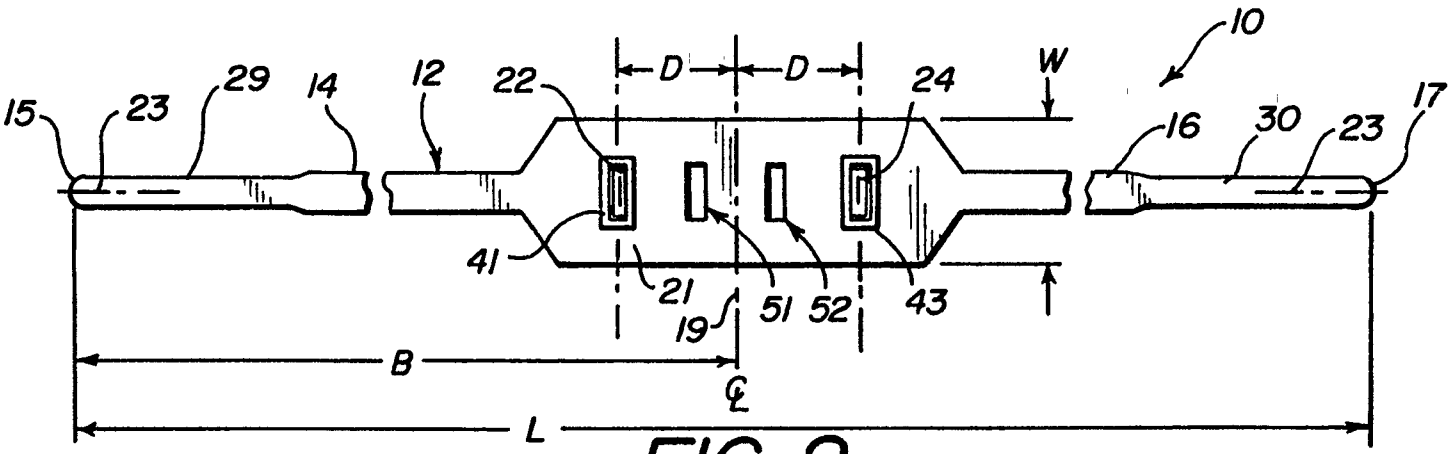
FIG. 2 is a plan view of the inner, skin-contacting surface of the strap restraint.
Figure 4:
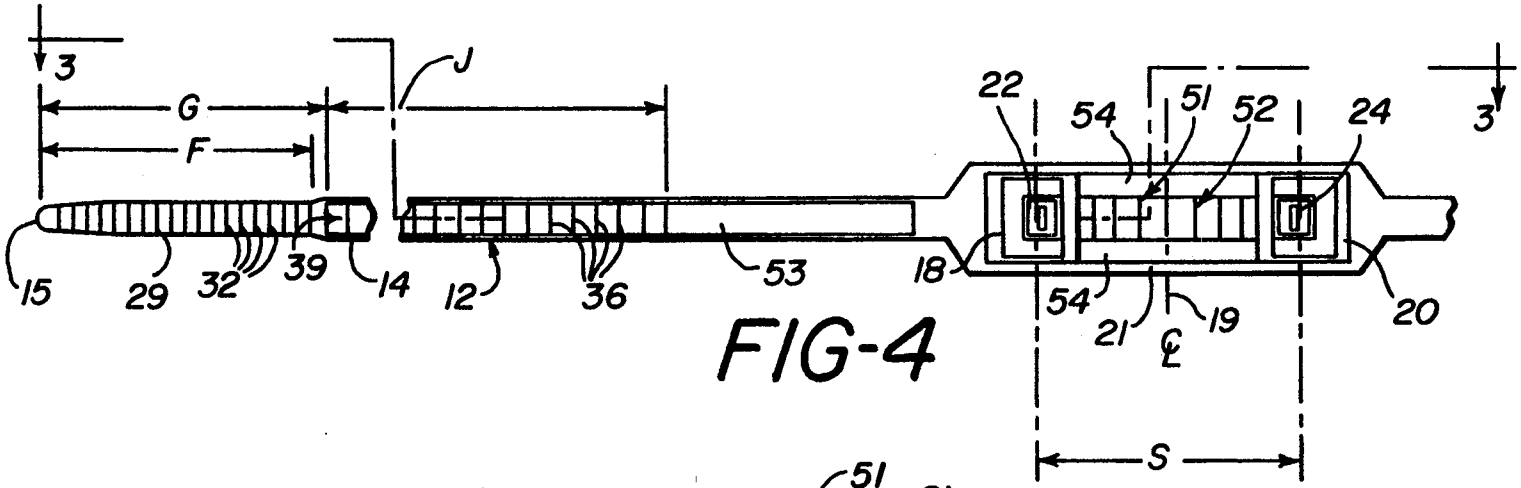
FIG. 4 is a plan view of the outer surface of the strap in FIG. 3 as taken along line 4—4 in FIG. 3.
Figure 4A:
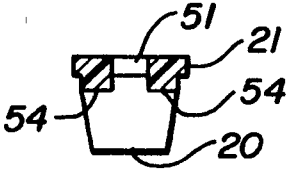
FIG. 4A is a cross-sectional view of the bridging portion of the strap restraint taken along the transverse section line 4A—4A in FIG. 3 and passing through one of the apertures used for compactly curling the strap as seen in FIG. 1.
Figure 5:
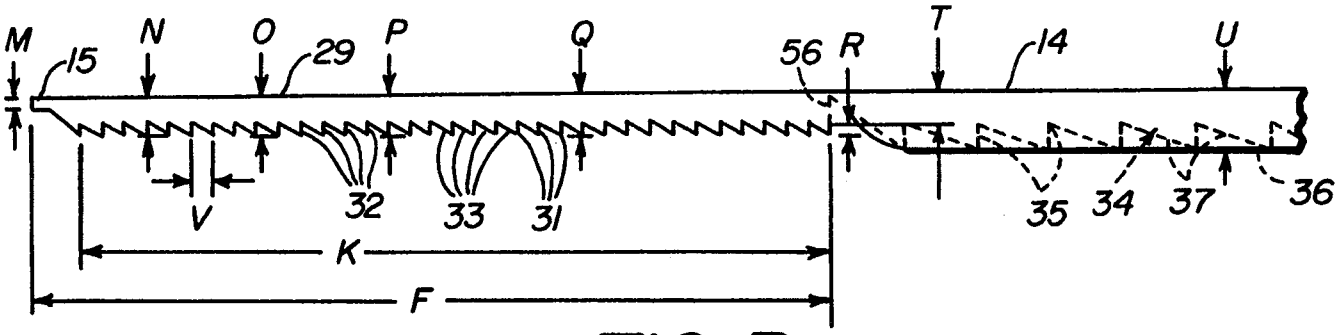
FIG. 5 is a partial, side elevational view showing a tip pull portion and part of the nearby ratchet portion of the strap restraint shown enlarged about four times.
Figure 6A:
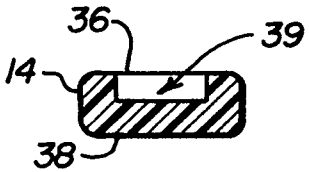
FIG. 6A is a cross-sectional view taken along the line 6A—6A in FIG. 6 and shown with the outward side of the strap facing upwardly.
Figure 6:
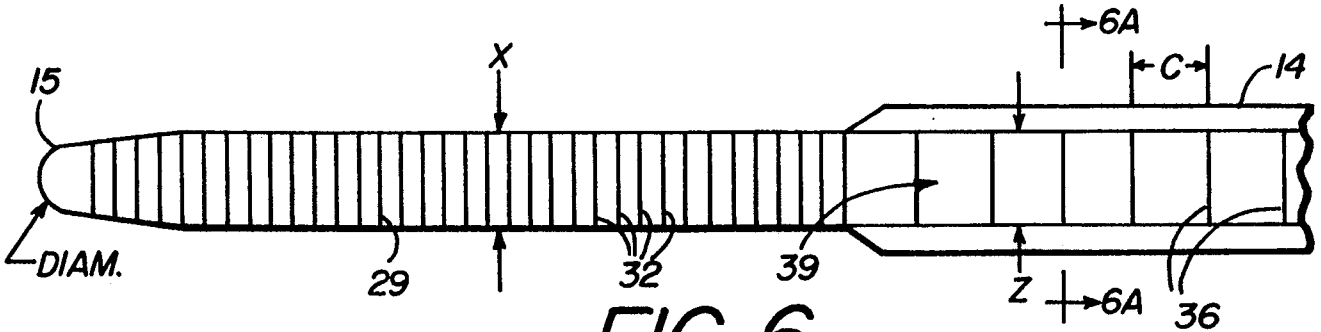
FIG. 6 is a partial plan view of the outer surface of a narrowed tip pull portion and nearby ratchet portion of the strap restraint shown enlarged about four times.

As best seen in FIGS. 2, 4 and 6, the strap includes a first narrowed tip pull portion 29 shown having a width as seen in FIG. 6, in the range of about 50% to about 70% of the width of the ratchet portion 14, for example being about 58%. This tip pull is tapered in thickness as seen in FIG. 5 and includes a plurality of small ridges 32 extending transversely with respect to the longitudinal centerline 23. These small ridges 32 have a saw-tooth configuration as seen in FIGS. 3 and 5 with their abrupt faces 31 being on the mesial surface of each ridge and with their sloping faces 33 being on the distal surface. The narrowed tip pull 29 has a length "F" (FIGS. 4 and 5). For example, this length F is in the range from about one inch to about two inches, and preferably is about 1.5 to about 1.8 inches, with most preferred dimension F of about 1.65 inches. The purpose of these saw-toothed tip pulls 29 and 30 is to provide a high frictional grip by an officer when pulling on it after the narrowed tip pull portion has been inserted fully through the socket opening 22 for enabling firm manual pulling of the ratchet portion 14 through the socket 18. The narrowed tip pull 29 leads to a ratchet toothed channel surface 34 having larger saw-tooth ridges 36 which slope in the same direction as the smaller ridges 32 of the tip pull. Thus, these larger saw-tooth ridges have abrupt mesial faces 35 and sloping distal faces 37 for providing a stiffly flexible longitudinally extending first ratchet portion 14 of the strap 12.

As seen in FIGS. 3, 4, 5, 6 and 6A, the ratchet portion 14 has a broad trough-shaped (broad U-shaped) configuration forming a channel 39 in which is located the saw-toothed surface 34. The broad flat surfaces 38 of the first and second ratchet portions 14 and 16 of the strap 12 are considered the "bottom" or "inward" surfaces, because such surfaces 38 are intended to face inwardly toward the wrist or ankle of the restrained person. Conversely, the surface containing the channel 39 is considered the "top" or "outward" surface. This top must face the resilient latch pawl 26 for it to engage against the abrupt mesial ridge faces 35 for latching the ratchet portion 14 in the socket as shown in FIG. 8.

The second ratchet portion 16 (FIG. 2) of the strap 12 is molded in the same shape as the first ratchet portion 14, except that this second ratchet portion is the symmetrical mirror image of the first. There is a second narrowed tip pull portion 30 (FIG. 2) which is molded in the same shape as the first tip pull portion 29, except that this second narrowed tip pull is the symmetrical mirror image of the first.

Figure 9:
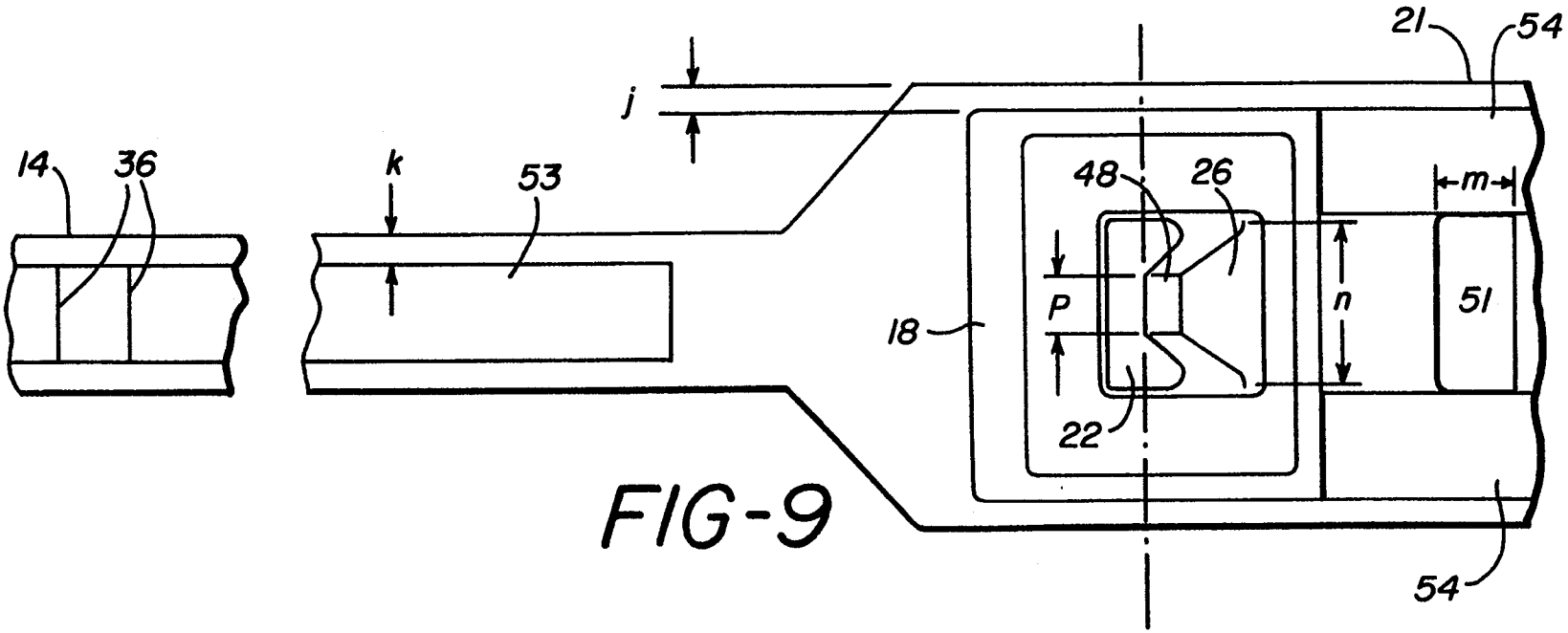
FIG. 9 is an enlargement about four times of one of the latching sockets shown in FIG. 4.

FIGS. 7, 8 and 9 more fully illustrate the structure of the socket 18 which has a central opening 22 with a funnel-shaped insertion mouth 41. The downwardly inclined latch pawl 26 projects into the central opening and is adapted to contact the teeth 36 of the saw-toothed channel surface 34 to latch for retaining the ratchet portion 14 within the socket 18 once it has been inserted therein and pulled into a final looped configuration 45 (FIG. 1*a*).

Figure 1A:
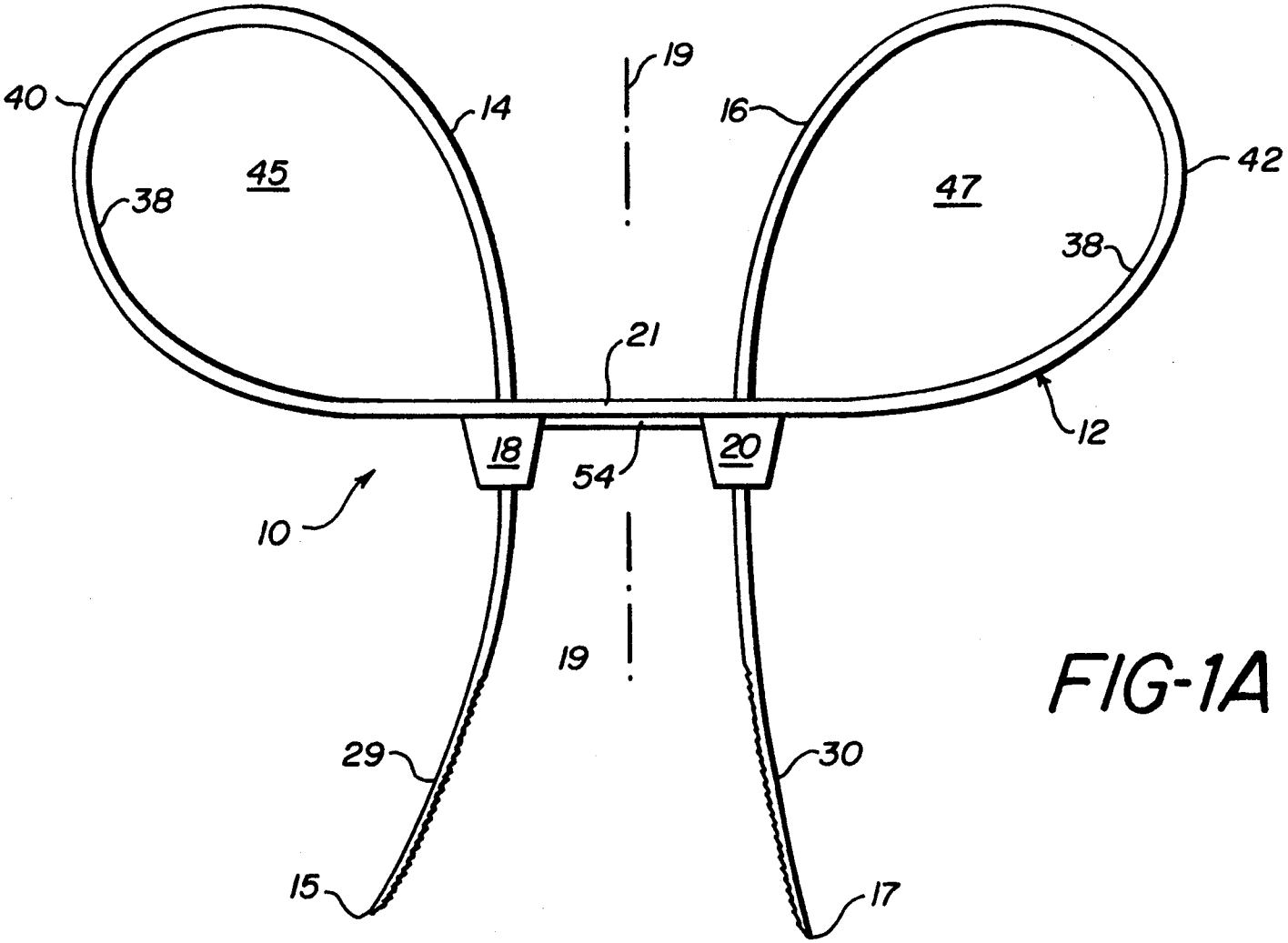
FIG. 1A is a side elevational view of the law enforcement restraint of FIG. 1 showing respective ratchet portions of the strap bent and inserted through respective latching sockets for providing a two-loop restraint.

In operation of a restraining device embodying the present invention it will be seen in FIG. 1A that the first ratchet portion 14 is flexed with its bottom (inward) surface 38 facing the wrist or ankle or other object being encircled to form a loop with its narrowed tip pull portion 29 having been inserted through the socket 18 in order for the stiffly flexible ratchet portion to be pulled therethrough to form a first loop 45. Then, the second tip pull 30 and ratchet portion 16 of the strap 12 are looped in the opposite direction and inserted into and pulled through the socket 20 to form a second loop 47.

The relatively close spacing "S" of the socket bosses 18 and 20 serves to restrain the person whose ankles or wrists are in the respective loop configurations 45 and 47. Moreover, since the ratchet portions 14 and 16 are stiffly flexible, they can be flexed as may be desired or required for configuring into various shapes and sizes of loops for snugly and accurately conforming to the perimeter of the encircled ankle, wrist or other anchoring object. In addition, there can be the same or different sizes of loops. The looping arrangement is simple and the flexing direction for each ratchet portion 14 and 16 is conveniently inwardly toward the transverse centerline 19. Thus insertion of the tip pull portions 29 and 30 into the sockets followed by securing the loops 45 and 47 is easy to do for quickly restraining a person.

It is noted that the first and second ratchet portions 14 and 16 project through their respective sockets generally parallel to each other, and so it is relatively easy to pull the loops 45 and 47 to be the same size, if so desired, by aligning the tip ends 15 and 17 in a final securing action.

The respective rounded tips and narrowed tip pull portions 15 and 29, 17 and 30 are shaped for ease of insertion into a socket opening 22 or 24, respectively. Since the socket bosses 18 and 20 protrude solely on the top (outward) surface of the strap 12, it is relatively easy for a user in total darkness at night to feel and determine almost immediately where these bosses are located and thereby to know where the funnel-shaped insertion mouths 41 and 43 are located opposite to the respective bosses, thus avoiding confusion and waste of time while facilitating appropriate quick insertion of the respective narrow tip pull portions 29 and 30.

As shown with respect to the latch pawl 26 (FIG. 8) in socket 18, each latch is inclined in the same direction as the distal sloping faces 37 of the saw-toothed ratchet ridges 36, and each latch pawl is resiliently deflectable permitting the latch pawl to ride over the ridges 36 in the upward direction of their slopes during insertion movement but preventing extraction movement, thereby providing a flexible strap ratchet arrangement, which makes the size of a loop 40 or 42 adjustable in the sense that the loop configuration 45 or 47 can always be made smaller until reaching the limit of the "Y" (FIGS. 3 and 4), as defined by the inner limit of the toothed channel surfaces 34. The strap has a smooth broad U-shaped portion 53 of length Y near each socket boss where the ratchet teeth are intentionally omitted. Thus, the ratchet portions 14 and 16 cannot become latched in such a tightly-bent loop configuration as to over-stress the strap 12 or socket. Y is about 1.8".

The ratchet portions 14 and 16 each include at least fifty ratchet teeth 36 extending for a length "J" (FIG. 4) of at least about 7.8 inches for providing a relatively wide range of adjustment. Preferably, there are at least about 9.36 inches. In a more preferred form as shown, there are seventy ratchet teeth extending for length J of about 10.92 inches.

By virtue of the fact that the sockets 18 and 20 are integral with the strap 12 and are located near the transverse centerline 19, the flexing direction is conveniently inwardly from both ends for forming both loops 40 and 42. The resulting dual-shaped configurations 45, 47 are advantageously generally symmetrical about the transverse centerline 19 in FIG. 1A, making the installation job easy for the officer, because the left and right loops are symmetrically the same regardless of which one is applied first and regardless of whether the rounded tip is at the left or right, because the overall strap 12 is completely symmetrical about both its transverse and longitudinal center-lines 19 and 25, thus advantageously being fully reversible end-for-end without altering its functional operation.

Although the double-tip configuration 45, 47 (as shown in FIG. 1A) illustrates a downward insertion of the ratchet portions 14 and 16 through their respective sockets 18 and 20, the strap 12 can be turned over if desired by the user, so that insertion can be in an upward direction, thereby forming an inverted symmetrical dual-loop configuration as will be seen by inverting FIG. 1A. Accordingly, with guidance by the outwardly protruding socket bosses 18 and 20, it is difficult to make a mistake, as this useful, disposable restraining tool 10 can be used to form a double-loop configuration 45, 47 in either direction and starting with either end. After the loops 45 and 47 have been pulled snug, the end portions of the extremities can then be snipped off, if desired, as being no longer needed. A relatively deep V-shaped notch 56 (FIG. 5) may be provided at the inner end of each tip pull for enabling the tip pull to be broken off by folding sharply at this notch.

The ratchet end 48 (FIGS. 7 and 8) of each resilient latch pawl is shaped, for example, by molding to have a flat surface which is pitched at an acute angle "A" (FIG. 8) for abutting flush against an abrupt mesial face 35 of a ratchet tooth 36. The inclination angle "K" (FIG. 7) of each resilient latch pawl is slightly steeper than the slope angle "D" (FIG. 7) on each ratchet tooth for providing reliably effective ratcheting and latching action. In a presently most preferred embodiment the pawl inclination angle K is 23 degrees with a ratchet tooth slope of 22 degrees. A resilient pawl length "h" (FIG. 7) of about 0.156 of an inch equals the longitudinal ratchet length "C" (FIG. 7) of one tooth 36. A pawl tip thickness "g" of about 0.070 of an inch shown. The pawl tip 48 is shown with a width "p" of about 0.170 of an inch for meshing into a ratchet channel width "A" (FIG. 6) about 0.187 of an inch. The pawl base width "n" is about 0.180 of an inch for providing stiff resilience while being slightly less than channel width Z. The socket opening 22 is shown in FIG. 7 having a clearance dimension "f" near the pawl base of about 0.135 of an inch for receiving a ratchet portion 14 having an overall thickness "U" of about 0.125 of an inch.

Figure 10:
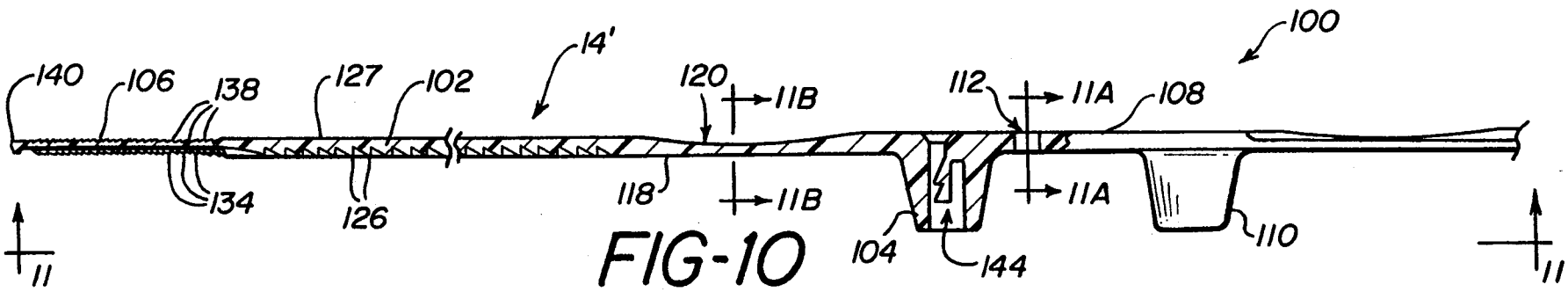
FIG. 10 is a side elevational view of more than half of a second embodiment of the restraint strap shown fully extended with a selected portion thereof shown in longitudinal cross-section.
Figure 11:
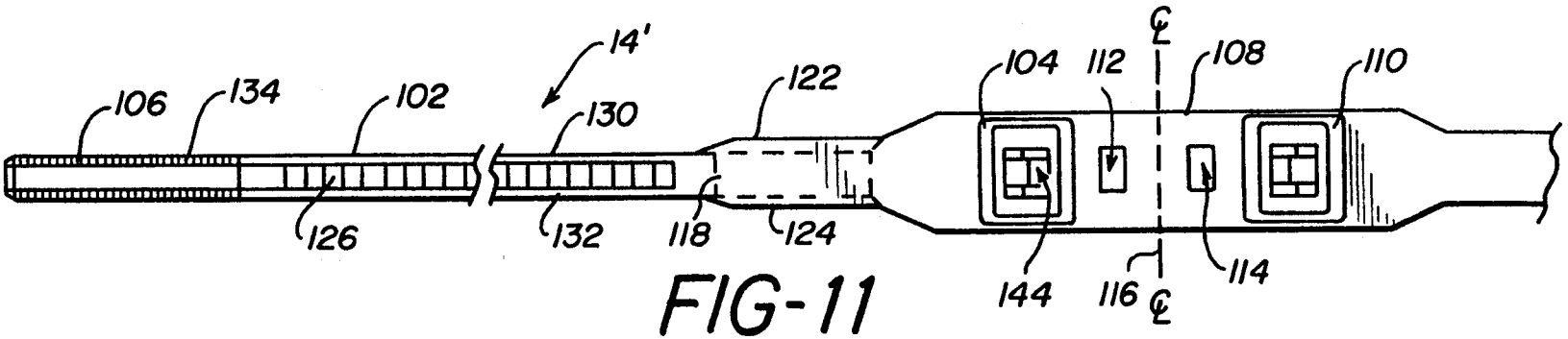
FIG. 11 is a plan view of the outer surface of the restraint as seen along the line 11—11 in FIG. 10.
Figures 11A, 11B:
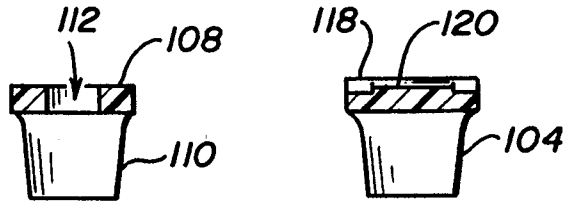
FIG. 11A is a cross-sectional view of one of the two apertures in the bridging portion as taken generally along the line 11A—11A in FIG. 10.
FIG. 11B is a cross-sectional view of a swale portion of a strap as taken generally along line 11B—11B in FIG. 10.
Figure 13A:
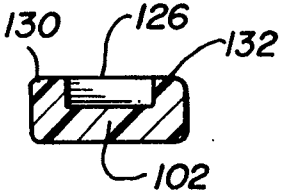
FIG. 13A is a cross-sectional view of the ratchet portion of a strap as taken generally along the line 13A—13A in FIG. 13.
Figure 12:
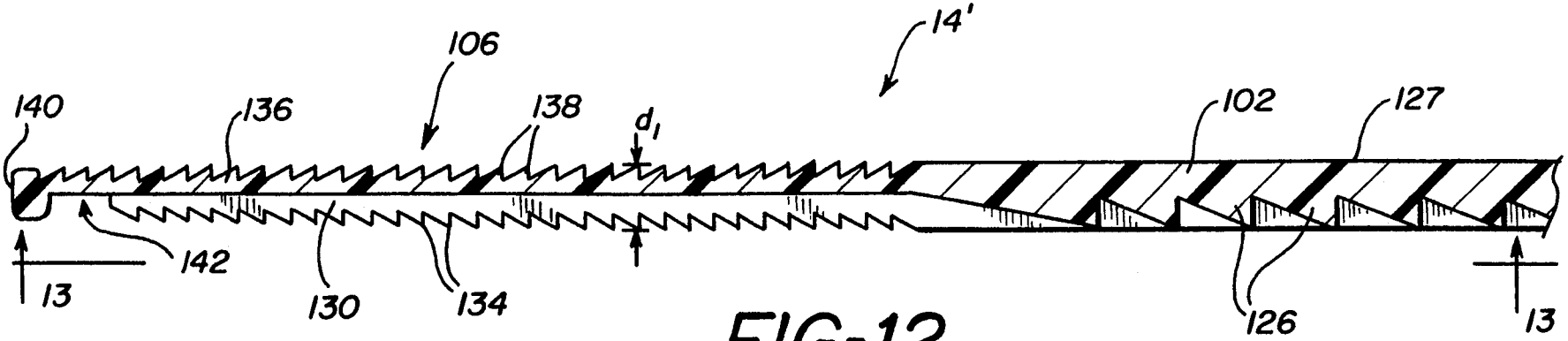
FIG. 12 is an enlarged, side elevational view in longitudinal cross-section of part of the ratchet portion of the strap including the tip pull end seen in FIG. 10.
Figure 13:
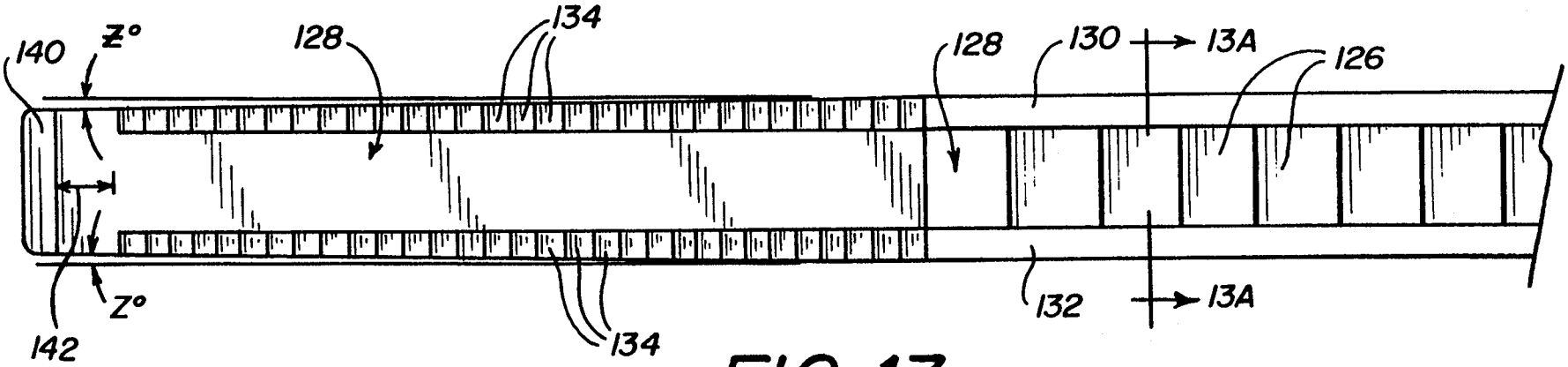
FIG. 13 is a plan view FIG. 12 as taken along the line 13—13 in FIG. 12.
Figure 14:
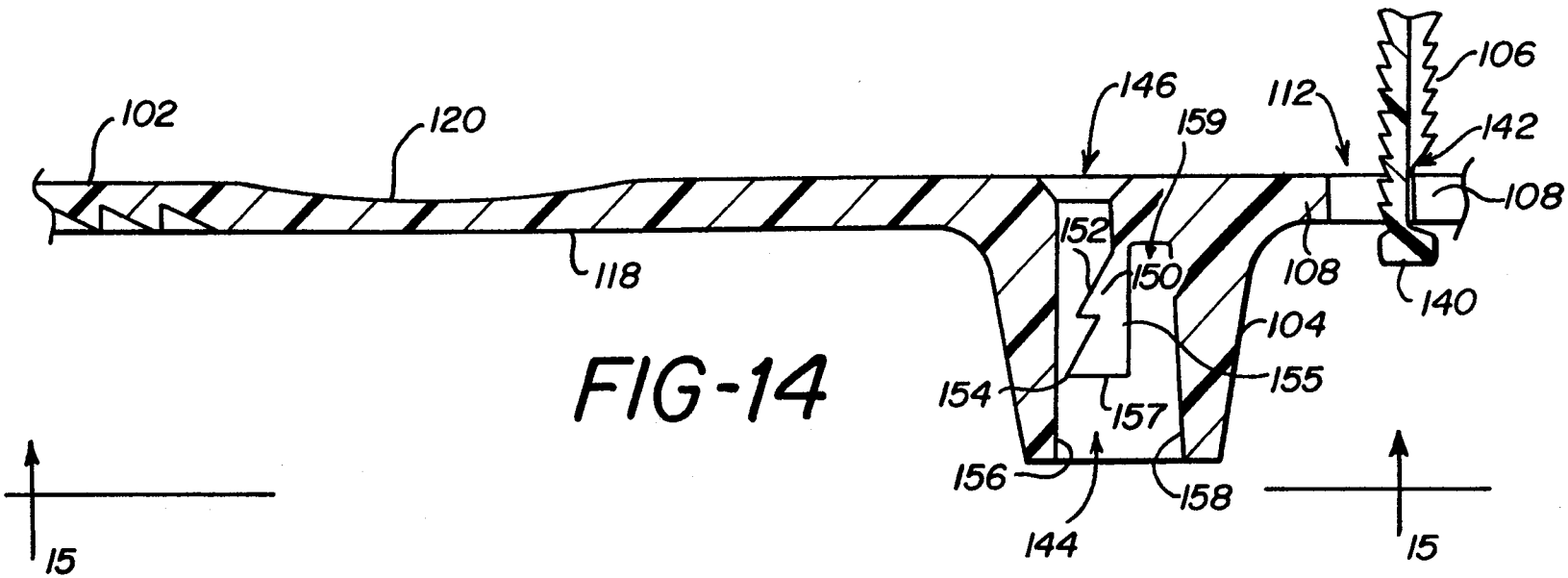
FIG. 14 is an enlarged, cross-sectional view of the latching socket including the swale and part of the ratchet portion of the strap on one side thereof, and an aperture in the bridging portion on the other side thereof. The tip pull end of the strap is shown (cut away) inserted and engaged within the aperture as is intended when the restraint is folded into the four-loop, storage configuration.

Referring now to FIGS. 10–18, a second embodiment of the restraint is shown generally by the numeral 100. It is seen that restraint 100 includes a ratchet portion 102 extending from a respective socket boss 104 and terminating into a tip pull 106. A central bridging portion 108 also extends between and integrally joins socket boss 104 with socket boss 110, and includes two apertures 112 and 114 spaced longitudinally therein. Although discussion hereafter will relate solely to the left half of restraint 100 as shown in FIGS. 10 and 11, it is understood that the right half of restraint 100 is the symmetrical mirror image of the left half as divided at the transverse center-line 116.

It will first be noticed that the non-ratchet portion 118 of restraint 100 extending between ratchet portion 102 and socket boss 104 includes a concave dip or swale 120 on the inwardly facing surface of restraint 100. Swale 120 improves the smooth flexing of strap 14' when moved into either the storage or securing configuration of two and one loop, respectively, as those configurations were explained previously.

Figure 15:
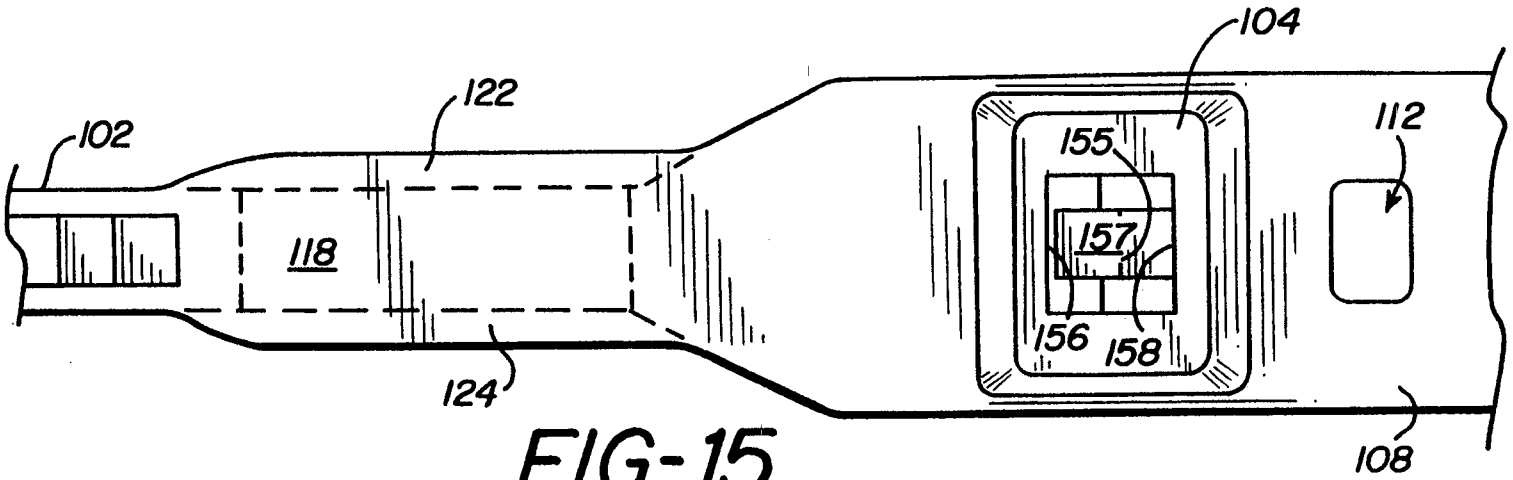
FIG. 15 is a plan view taken along the line 15—15 in FIG. 14.

Portion 118 is also widened along either side thereof to include "ID-Tag" areas 122 and 124 as seen best in FIG. 15. Areas 122 and 124 are treated with a Patina finish which allows permanent inking thereon, for example, by a police officer with a pen or marker to identify the restrainee. Other methods of identification are envisioned such as use of magnetic bar codes on areas 122 and 124 which may be read for identification with a magnetic bar code reader (not shown).

By virtue of areas 122 and 124 increasing the width of portion 118 as compared with the width of portion 53 of restraint 10, the tensile and flexural strengths of restraint 100 are increased as compared to the same strengths of restraint 10.

As with strap 14 of restraint 10, strap 14' of restraint 100 includes a ratchet portion 102 having ratchet teeth 126 extending 132. Ribs 130 and 132 continue to linearly extend along tip pull portion 106 at which point each rib 130 and 132 include closely spaced saw teeth 134. Opposite, inner surface 136 of tip pull 106 also includes closely spaced saw teeth 138 extending transversly edge to edge in the same manner as teeth 32 on tip pull 15 of the embodiment of FIGS. 1–9. Saw teeth 134, in addition to saw teeth 138, greatly enhance manual grasping and manipulation of tip pull 106 from the straightened, flat condition of restraint 100, to the folded condition of restraint 100, either in the one-loop secured position or two-loop storage position.

It will further be noticed that tip pull 106 tapers slightly inwardly an amount of "Z" degrees along either edge thereof to an elongated, terminal enlargement 140. Ribs 130 and 132 terminate prior to reaching enlargement 140 thereby forming a slot 142 therebetween. As such, slot 142 will bear against the inner wall of aperture 112 closest to center-line 116 with enlargement 140 "catching" or engaging the edge of aperture 112 when tip pull 106 is passed therethrough in forming the two-loop, storage configuration of strap 102 (FIG. 14), the second loop not being shown for the sake of clarity. Unintentional withdrawal of tip pull 106 from aperture 112 is thereby avoided which may occur with prior embodiments of the present invention such as tip pull 15.

Enlargement 140 is furthermore useful as it cannot enter socket boss 104 in the wrong direction, i.e., it cannot enter through opening 144 and exit opening 146 as will be appreciated when described more fully below.

Referring now to socket boss 104 and particularly to the latch pawl 150 integrally formed therein, it is seen best in FIGS. 14–17 that pawl 150 includes two consecutively adjacent teeth or individual pawls 152 and 154 facing inner surface 156 of socket boss 104. Pawl 150 is resiliently deflectable within socket boss 104 and in the undeflected condition seen in FIG. 14, surface 155 thereof (opposite teeth 152 and 154) lies substantially parallel to opposite, facing inner surfaces 156 and 158 of socket boss 104, a pocket 159 of generally U-shaped cross-section being formed between pawl surface 155 and boss inner surface 158. It will also be noticed pawl 150 lies substantially mid-way between surfaces 156 and 158, integrally connected to and extending from the solid portion of socket boss 104 between socket entrance opening 146 and bridging portion 108.

As mentioned previously, enlargement 140 cannot enter socket boss 104 in the wrong direction through unintentional insertion into the exit socket opening 144. Although not shown, it may readily be realized that the end surface 157 of pawl 150 would block the passing of enlargement 140 through to reach socket entrance opening 146 coming from the direction of socket exit opening 144.

Figure 17:
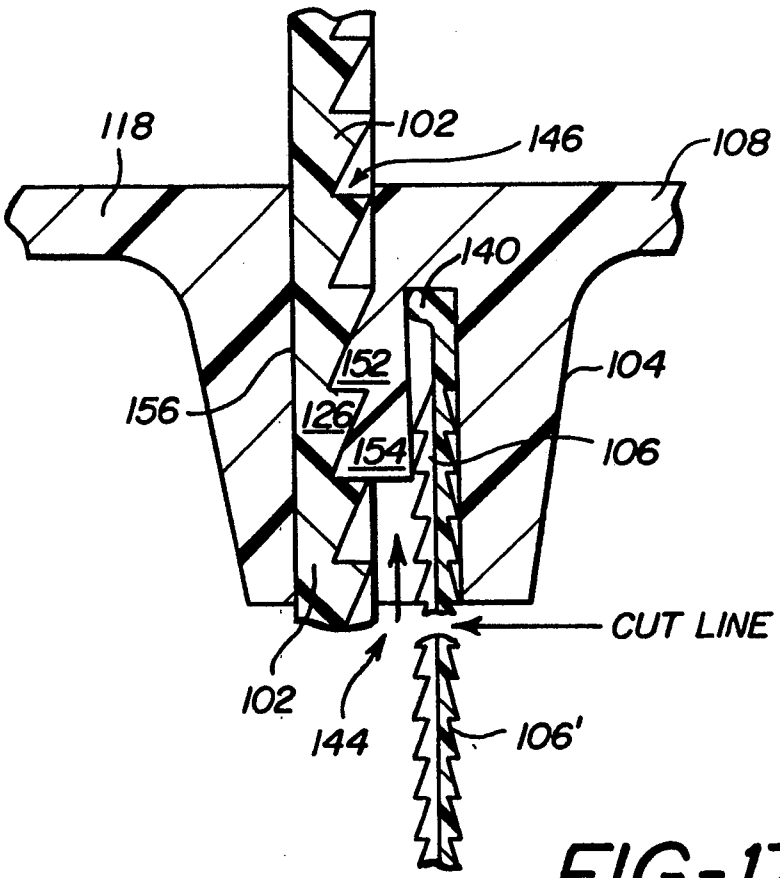
FIG. 17 is the view of the FIG. 16 and further showing the tip pull end of the ratchet portion (which is the portion cut away in FIG. 16) inserted between the double pawls and interior wall of the latching socket in the intended manner.
Figure 16:
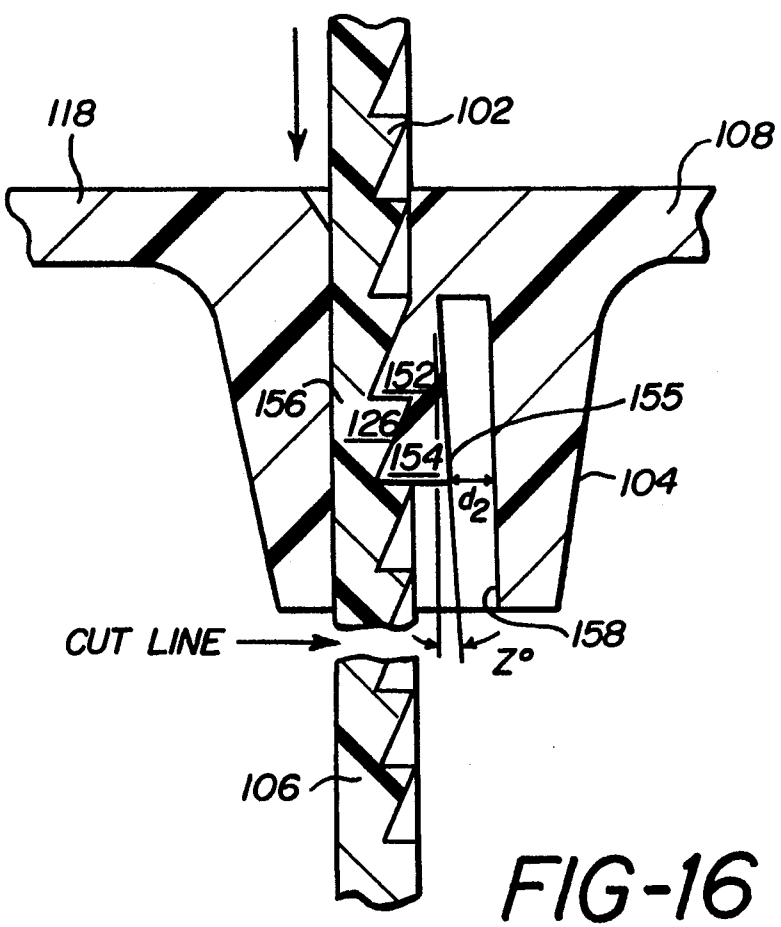
FIG. 16 is an enlarged, cross-sectional view of the latching socket seen in FIGS. 14 and 15 showing the ratchet portion of the strap engaged with the integral double pawl therein and also showing the portion of the ratchet portion which is cut therefrom following securement of the strap into the two-loop configuration about an individual's wrists or ankles.

Referring to FIGS. 16 and 17, ratchet portion 102 is shown in the secured position fully inserted through socket boss 104 in the correct and intended manner. The restrainee's limb is laid against the smooth inner surface 127 (FIGS. 10 and 12) of strap 14' opposite ratchet teeth 126 and tip pull 106 is grasped and strap 14' is looped to encircle the restrainee's limb. Enlargement 140 is inserted into socket entrance opening 146 and fed through socket boss 104 until it exits socket exit opening 144. When a length of tip pull 106 has exited socket boss 104 sufficient to securely grasp, tip pull 106 is pulled with the ratchet teeth 126 adjacent tip pull 106 contacting and riding over pawl teeth 152 and 154. Since pawl 150 is resiliently deflectable, ratchet teeth 126 easily ride over pawl teeth 152 and 154 and any two adjacent ratchet teeth 126 may engage with cooperatively formed pawl teeth 152 and 154.

Ratchet portion 102 is of course only movable in the direction from socket entrance opening 146 to socket exit opening 144. Strap 14' is thus pulled to snugly fit about the restrainee's limb with teeth 152 and 154 preventing withdrawal of strap 14' from socket boss 104. The double tooth design of pawl 150 provides increased surface area contact and two retention points between pawl teeth 152, 154 and any two adjacent ratchet teeth 126 thereby providing improved retention of ratchet portion 102 within socket boss 104 than is available with single pawl designs.

Referring to FIGS. 16 and 17, it is seen that pawl 150 deflects toward inner surface 158 of socket boss 104 an amount of "z" degrees when ratchet portion 102 is inserted through boss 104 with ratchet teeth 126 in tight, abutting contact with pawl teeth 152 and 154. Once strap 14' has been secured about the restrainee's limb to the desired tightness, the portion of strap 14' (which includes enlargement 140) extending loosely from socket boss 104 (indicated at 106) may be cut or otherwise severed adjacent socket exit opening 144 as indicated by the cut line arrow in FIG. 16. Portion 106 may thereafter be inverted and enlargement 140 inserted into socket exit opening 144 between surface 155 of pawl 150 and socket boss inner surface 158. The distance $d_1$ between the terminal tips of saw teeth 134 and 138 on either surface of tip pull 106 (FIG. 12) is substantially equal to the distance $d_2$ between surface 155 of deflected pawl 150 and socket boss inner surface 158 (FIG. 16). Thus, tip pull 106 tightly fits between pawl 150 and inner surface 158. Once fully inserted as seen in FIG. 17, the extraneous length 106' of cut tip pull portion 106 may be cut or severed a second time closely adjacent socket boss 104 as indicated by the cut line arrow in FIG. 17. Inserted tip pull 106 is tightly, frictionally held against pawl 150 and is not easily withdrawn therefrom, therefore providing an effective lock against unauthorized tampering in an effort to release ratchet portion 102 from socket boss 104. Furthermore, pawl 150 is unable to move laterally within socket boss 104 which increases the tensile strength of cuff 100 to the point where breakage of the cuff by a person wearing them in the intended manner is nearly impossible.

Figure 18:
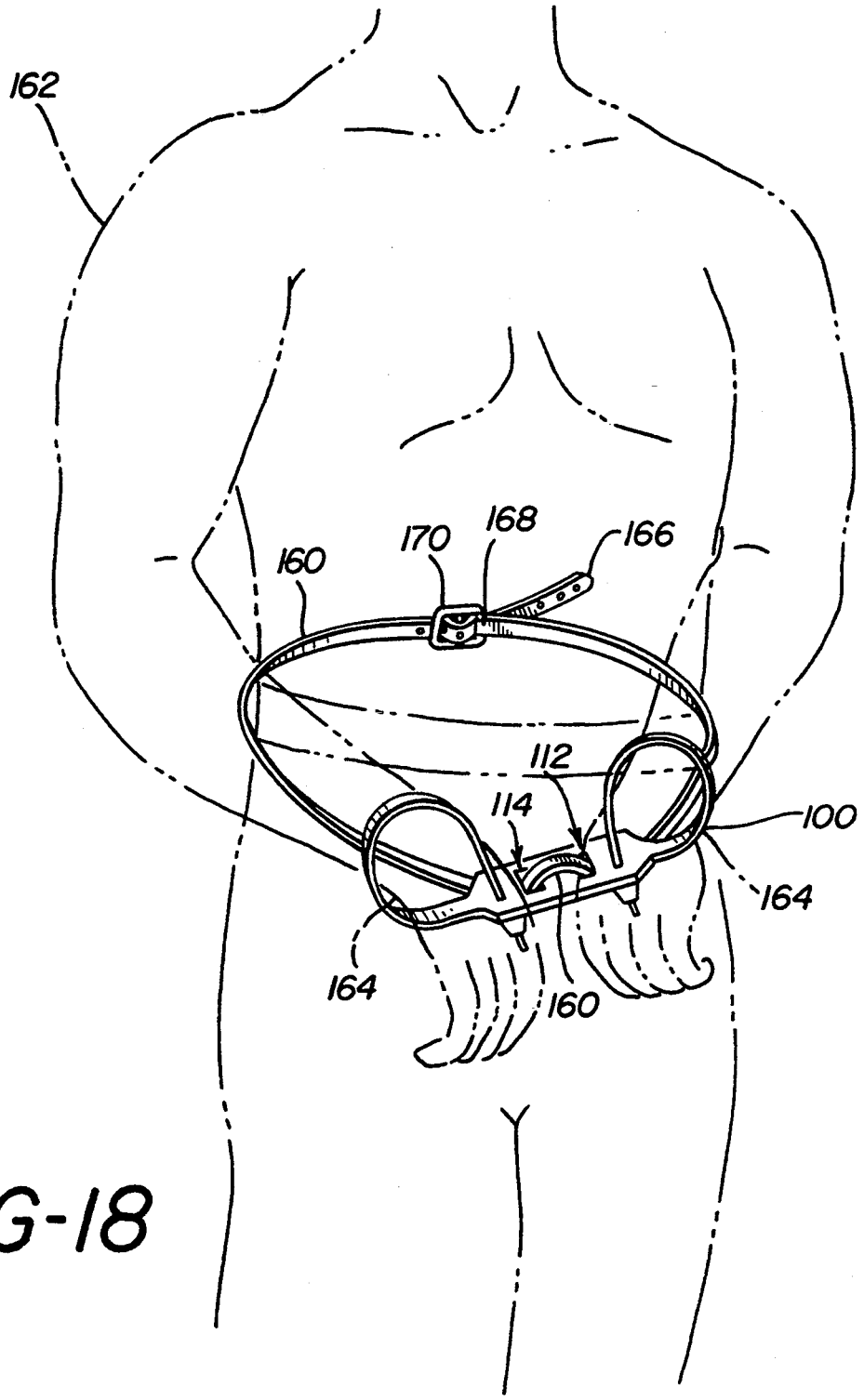
FIG. 18 is a perspective view of a person shown in phantom restrained about the wrists with the restraint of the invention and further including an elongated belt secured about the person's waist and attached to the restraint by passing through the apertures in the central bridging portion which may be used to further restrain the person's arm movement.

Referring to FIG. 18, a yet further embodiment of the invention is shown to comprise the addition of an adjustable belt 160 which may be made of the same thermoplastic material as cuff 100. Belt 160 is used to restrict arm movement of a person 162 wearing cuff 100 about the wrists 164. A first end 166 is inserted through a first aperture 112 in a first direction and then inserted through the other aperture 114 in the opposite direction thereby securing belt 160 to cuff 100. Belt 160 is pulled through the apertures such that the free end 166 thereof may be wrapped around the waist of person 162 and secured to the belt opposite end 168 at the back of the person. Any known adjustable securing means such as belt buckle 170 are provided to adjust the tightness of the belt about the person's waist. It may thus be realized that belt 160, in combination with cuff 100 (or any other previously disclosed cuff having apertures in the central bridging portion such as 112 and 114), provides an effective hand and arm restraint.

What is claimed is:

1. An elongated, flexible strap having first and second, opposite terminal ends and an outer surface and opposite inner surface longitudinally extending between said terminal ends, said strap being movable between a first, linear position with said first and second, opposite ends being a maximum distance apart, and a second, looped position for restraining first and second limbs of a person with portions of said strap inner surface lying in contacting relation to said limbs, said strap comprising:

a) first and second sockets having openings extending through said strap in a direction substantially perpendicular to the plane said strap lies when in said first, linear position, said first and second sockets being longitudinally spaced from each other along said strap in a position substantially mid-way between said first and second, terminal ends with a bridging portion being defined between said first and second sockets;

b) first and second, elongated ratchet portions having a plurality of ratchet teeth extending along said strap outer surface between said first socket and said first terminal end, and said second socket and said second terminal end, respectively; and c) first and second, resiliently deflectable latch pawls positioned in said first and second sockets, respectively, said first and second latch pawls each having first and second, adjacent pawl teeth lying along a line extending parallel to said direction which said socket openings extend, said first and second ratchet portions movable in a first, insertion direction through said first and second sockets, respectively, with said pawl teeth on said first and second latch pawls engaging said ratchet teeth peventing said first and second ratchet portions from moving in a second, withdrawal direction opposite said first direction, said strap thereby assuming said second, looped position with said first and second ratchet portions forming first and second loops, respectively.

2. The invention according to claim 1 wherein said strap further comprises first and second tag portions integrally extending between said first socket and first ratchet portion, and said second socket and second ratchet portion, respectively, said first and second tag portions each having a width greater than the width of said first and second ratchet portions.

3. The invention according to claim 2 wherein said bridging portion has a width greater than said tag portions.

4. The invention according to claim 2 wherein said tag portions include means for permanently receiving inked identification indicia thereon.

5. The invention according to claim 4 wherein said permanent receiving means comprises a patina finish on one of said inner and outer surfaces of said strap at said tag portions.

6. The invention according to claim 2 wherein said tag portions each include a longitudinally extending swale indentation on said inner surfaces thereof.

7. The invention according to claim 1 and further comprising first and second tip pull portions linearly extending from said first and second ratchet portions and forming said first and second terminal ends, respectively, said tip pull portions each including a first set of saw teeth longitudinally extending along at least one of said inner and outer surfaces thereof.

8. The invention according to claim 7 wherein said first and second tip pull portions further include a second set of saw teeth longitudinally extending along the other of said at least one of said inner and outer surfaces thereof.

9. The invention according to claim 8 wherein said strap outer surface includes first and second flanges longitudinally traversing along opposite edges of each of said ratchet portions and said tip pull portions thereby forming a longitudinal channel between said first and second flanges and wherein said ratchet teeth are positioned.

10. The invention according to claim 9 wherein said second set of saw teeth extend along said first and second flanges on each of said first and second tip pull portions.

11. The invention according to claim 1 wherein said bridging portion includes first and second apertures extending therethrough adjacent to and in the same direction as said first and second sockets, respectively, and wherein said strap is movable between said first, linear position and a third, storage position where said first and second ratchet portions removably extend through said first and second apertures, said apertures having a width at least twice the thickness of said ratchet portions such that each of said first and second ratchet portions may have two separate portions thereof extending through said first and second apertures simultaneously, respectively, when in said third, storage position.

12. The invention according to claim 11 wherein said first and second, terminal ends each include a transversely extending flange on said outer surfaces thereof, said flanges adapted to removably engage an edge of said first and second apertures furthest from the adjacent first and second socket, respectively, when said strap is in said third, storage position.

13. The invention according to claim 1 wherein said strap further includes first and second socket bosses wherethrough said socket openings extend and wherein said first and second latch pawls are positioned, respectively.

14. The invention according to claim 13 wherein said first and second socket bosses protrude from said strap outer surface.

15. The invention according to claim 14 wherein said first and second latch pawls deflect toward each other when said first and second ratchet portions are passed through said first and second sockets, respectively, in said first insertion direction.

16. The invention according to claim 15 wherein the thickness of said first and second, terminal ends is substantially the same as the distance between said deflected latch pawl and the inner wall of said socket boss opposite its respective said inserted ratchet portion, whereby said terminal end may be inserted into said socket boss between said latch pawl and said socket inner wall in a direction opposite said insertion direction to strengthen the engagement between said ratchet teeth and said pawl teeth.

17. The invention according to claim 15 wherein the thickness of each of said first and second, terminal ends is greater than the distance between an undeflected said latch pawl and the inner wall of said socket boss adjacent said ratchet portion, whereby said undeflected latch pawl acts as a stop to prevent insertion of said terminal end into said socket opening in a direction opposite said first insertion direction.

* * * * *